United States Patent [19]

Rosseel et al.

[11] Patent Number: 4,673,004

[45] Date of Patent: Jun. 16, 1987

[54] ADJUSTABLE CONTROL OF THE WEFT ON A WEAVING LOOM

[75] Inventors: Rik Rosseel, Ypres; Bernard Decock, Wevelgem; Marc Wyffels, Ypres; Frank Ampe, Middelkerke, all of Belgium

[73] Assignee: N.V. Weefautomaten Picanol, Belgium

[21] Appl. No.: 733,728

[22] Filed: May 14, 1985

[30] Foreign Application Priority Data

May 16, 1984 [BE] Belgium ..... 2/60415

[51] Int. Cl.[4] ..... D03D 47/30

[52] U.S. Cl. ..... 139/435; 139/452

[58] Field of Search ..... 139/435, 452

[56] References Cited

U.S. PATENT DOCUMENTS

| | | | |
|---|---|---|---|
| 4,020,877 | 5/1977 | Spisiak et al. | 139/435 |
| 4,446,893 | 5/1984 | Gunnemann et al. | 139/435 |
| 4,458,726 | 7/1984 | Wenig | 139/435 |
| 4,463,783 | 8/1984 | Suzuki et al. | 139/435 |
| 4,534,387 | 8/1985 | van Hest | 139/435 |
| 4,550,753 | 11/1985 | Tsuji | 139/435 |

FOREIGN PATENT DOCUMENTS

| | | | |
|---|---|---|---|
| 0107110 | 5/1984 | European Pat. Off. . | |
| 114047 | 7/1984 | European Pat. Off. | 139/435 |
| 84/02360 | 6/1984 | World Int. Prop. O. . | |
| 84/02326 | 6/1984 | World Int. Prop. O. . | |
| 2065726 | 7/1981 | United Kingdom . | |

*Primary Examiner*—Henry S. Jaudon

*Attorney, Agent, or Firm*—Bacon & Thomas

[57] ABSTRACT

An adjustable control for weft thread delivery of an air jet weaving loom includes a system for selectively controlling the control time and the duration of master weft delivery jets in response to measurements made of weft thread delivery during the weaving process. Different types of weft threads are provided with their own master jets that are independently controllable as to duration time and/or control time. The duration and/or control time of auxiliary jets disposed along the shed of the loom are also controllable in response to detected weft motion. The system also includes a control system for the weft supply drums responsive to detected weft thread delivery during the weaving process.

21 Claims, 1 Drawing Figure

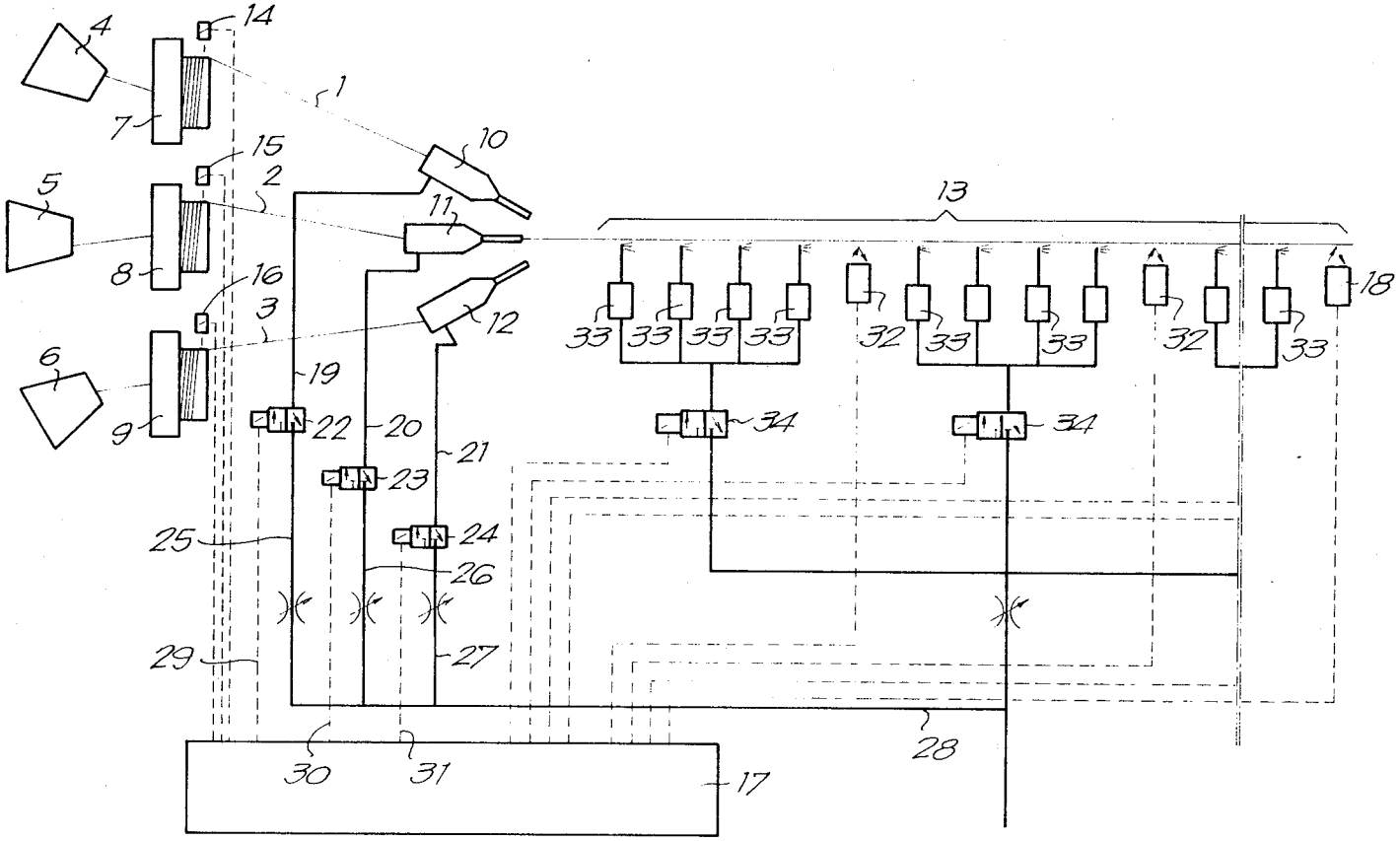
1
2
3
4
5
6
7
8
9
10
11
12
13
14
15
16
17
18
19
20
21
22
23
24
25
26
27
28
29
30
31
32
33
34

ADJUSTABLE CONTROL OF THE WEFT ON A WEAVING LOOM

BACKGROUND OF THE INVENTION

1. Field of the Invention

This invention relates to an adjustable control system for the weft on a weaving loom. more specifically, this is a control mechanism which enables the weft thread to be controlled according to a predetermined fixed pattern and the control mechanism to be adjusted while the machine is in operation, according to measured results of weft movement.

2. Background of Invention and Prior Art

More specifically, this invention also relates to a control in weaving machines in which the weft is inserted in the shed by means of a master jet mechanism powered by compressed air and supported for movement through the shed by auxiliary jet mechanisms located in the shed.

In such a weaving machine there will be as many master jet mechanisms and weft storage units, more specifically a thread bobbin and a so-called storage drum, as there are numbers of different types of weft threads which will make up the fabric concerned. It is also known that it is necessary for the control of different types of weft thread to vary weft speed in order to reduce to a minimum the risk of weaving faults with the best possible chance of successful weft thread movement. Indeed, it is known that a slower timing sequence must be followed for a heavier and/or smoother weft thread. In other words, a lower weft movement speed must be selected than would be used for lighter or rougher yarns. It is further known that one of the control parameters of the above-mentioned air jet weaving machines is the timing sequence according to which the thread movement is controlled, i.e. the time in each weaving cycle at which the control of each component begins (control time) on one hand and the duration of this control, the duration time, on the other hand.

The first object of the invention is thus related to the fact that the timing sequence of the components which are used for the movement of the weft thread is adapted to the type of weft thread inserted for each shot. For this purpose, a number of timing sequences are introduced into the control mechanism of the weaving machine which correspond to the weft threads to be woven. Thus, a specific timing sequence stored in the control mechanism is used for the control of the components involved in the movement of the weft thread, depending on the weft thread to be inserted at a particular moment.

It is obvious that when a specific type of thread is inserted, the duration time of the control of a component of the control mechanism can thus vary from zero to a maximum value, wherein the duration time will be set at zero not only for the control of the storage drums and the master jet mechanisms for the wefts which are not involved at that point in the weaving cycle in progress, but also for a certain number of auxiliary jets should this be required due to the thread movement.

The second object of the invention consists of the installation of mechanisms in the path of the weft thread movement which enable certain measurements to be made relating to the weft thread movement. These measurements consist primarily of determining the time taken between the departure of the weft thread at the insertion end of the shed and the arrival of the head of the weft thread in particular at the other end of the shed. In this process the signal from the weft stop motion, which as already known observes the head of the weft thread at the end of the weft movement, may be used for this latter measurement.

As specified according to the invention, for each type of weft thread and taking the type of weft thread concerned into account, the time thus measured is used to modify and optimize the timing sequence associated with a specific type of weft thread and subsequently, subject to observance of the physical order in the timing sequence for the control of the consecutive jet mechanisms, to progressively change the parameters of this order until an adequate speed of the weft movement is obtained.

Thus the control obtained is not only adapted to the maximum obtainable speed for the movement of a specific type of weft thread but, in addition, a highly efficient consumption of compressed air is also achieved.

A mechanism as specified according to the invention which demonstrates the aforementioned and other characteristics is of the type which contains a separate master jet for each type of weft, to which the appropriate operating pressure is applied according to the type of weft thread, in which this master jet is supplied from a separate storage drum and whereby the auxiliary jets also operate with a regulated operating pressure and both the master jets and the auxiliary jets are controlled according to a specific timing sequence. This type of mechanism is also characterized by the fact that at least the control time and/or the duration time of the master jets are adjusted according to a measurement made during the weaving operation.

BRIEF DESCRIPTION OF THE DRAWING

With a view to illustrating the characteristics of the invention to better advantage and purely as an example with no limiting character, a drawing of the system as specified according to the invention is attached

BRIEF DESCRIPTION OF PREFERRED EMBODIMENTS

A mechanism is illustrated in the drawing in which three different types of weft thread 1, 2 and 3 respectively are used and which are unwound from bobbins 4, 5 and 6 respectively by means of a thread feeder mechanism 7, 8 and 9 respectively which is in itself well known.

These weft threads 1, 2 and 3 are then fed to the master jets which are illustrated schematically by 10, 11 and 12 and which are arranged with respect to the shed of the weaving machine, 13 on the diagram, in a well-known manner.

The weft thread feeder mechanisms 7, 8 and 9 are each controlled by control units, 14, 15 and 16 respectively, which in their turn are controlled by control unit 17 preferably by means of a microprocessor.

Control units 14, 15 and 16 typically may comprise solenoid or other electrically controllable elements that, when not energized, normally hold the weft thread against winding drum sections of the feeder mechanisms 7, 8 and 9 about which the thread is wound in precise lengths before it is fed to the jets 10, 11 and 12. When energized by an appropriate signal from microprocessor 17, the control units 14, 15 and 16 release a predetermined length of weft thread that is fed to the jets 10, 11 and 12. In accordance with the present invention, control time (moment of release) and duration time (time period of release) of energization of the control units 14, 15 and 16 can be controlled in response to measurements made by sensors 18 and 32 via the central processor 17.

The master jets 10, 11 and 12 are each supplied by pipes, 19, 20 and 21 respectively, which are fitted with control units, 22, 23 and 24 respectively, to supply compressed air under ideal conditions to the jets 10, 11 and 12 in which these control units 22, 23 and 24 are connected via air pipes 25, 26 and 27 to a common air supply 28 which is connected to a compressed air tank not illustrated in the diagram and to the control circuit 17 via electical connections 29, 30 and 31 in order to enable the duration of the operation of the jets 10, 11 and 12 to be determined. One or more series of auxiliary jets 33 are positioned in the shed and controlled by means of a control valve 34, whereby this control valve is also connected to the above-mentioned common pipe 28 and the control circuit 17.

As specified according to the present invention, one or more sensors 32 may also be fitted, distributed over the loom width, in order that the passing of the head of the weft thread may be signalled to the control circuit 17 and that these cycle times may lead to a better knowledge of the order which applies to the movement of each type of weft through the shed, thus enabling the optimization of the timing sequence for the jet mechanism control to be increased.

The mechanism as specified according to the invention enables the most appropriate timing sequence for a specific type of weft thread 1, 2 or 3 to be stored in the control circuit 17 so that control units 14, 15 and 16 and/or 22, 23 and 24 are controlled according to this timing sequence and whereby the weft time is monitored at least at the end of the weft movement by the weft stop motion 18 in order that the measurement obtained may be compared with the timing sequence stored in the control circuit 17 and the timing sequence may thus be adjusted automatically in the control circuit. This process adjusts the above-mentioned control units according to the measurement made by the weft stop motion and thus the speed of the weft thread movement may be progressively increased to maximize the speed while minimizing the risk of the occurrence of weaving faults.

It is clear that the present invention is in no way restricted to the layout described as an example and illustratedd in the accompanying diagrams, but that such a mechanism may be manufactured in a variety of shapes and sizes without exceeding the scope of the invention.

We claim:

1. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for selectively controlling the control time and the duration time of the master jets in response to measurements of weft thread delivery made during the weaving process.

2. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for controlling the control time of the master jets in response to measurements of weft thread delivery made during the weaving process.

3. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for controlling the duration time of the master jets in response to measurements of weft thread delivery made during the weaving process.

4. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for selectively controlling the control time of at least one auxiliary jet in response to measurements of weft thread delivery made during the weaving process.

5. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for selectively controlling the control time of a series of auxiliary jets in response to measurements of weft thread delivery made during the weaving process.

6. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for controlling the control time of at least one auxiliary jet in response to measurements of weft thread delivery made during the weaving process.

7. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for controlling the duration time of at least one auxiliary jet in response to measurements of weft thread delivery made during the weaving process.

8. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for controlling the control time a series of auxiliary jets in response to measurements of weft thread delivery made during the weaving process.

9. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least one delivered weft thread sensor (32) located along the loom width and means (18) for sensing weft stop motion; and means for controlling the duration time a series of auxiliary jets in response to measurements of weft thread delivery made during the weaving process.

10. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least means (18) for sensing weft stop motion of the loom; and means for selectively controlling the control time and duration time of the control units (14, 15 and 16) of the supply drums (7, 8 and 9) in response to measurements of weft thread delivery made during the weaving process.

11. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least means (18) for sensing weft stop motion of the loom; and means for controlling the control time of the control units (14, 15 and 16) of the supply drums (7, 8 and 9) in response to measurements of weft thread delivery made during the weaving process.

12. In an adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, the improvement comprising means for measuring weft thread delivery made during the weaving process, said measuring means comprising at least means (18) for sensing weft stop motion of the loom; and means for controlling the duration time of the control units (14, 15 and 16) of the supply drums (7, 8 and 9) in response to measurements of weft thread delivery made during the weaving process.

13. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, said adjustable control comprising the combination of:

means for measuring weft thread delivery during the weaving process, said measuring means disposed along the loom width;

means for selectively adjusting the control time and the duration time of the master jets (10, 11 and 12) in response to the measurement of weft thread delivery made during the weaving process;

means for selectively adjusting the control time and the control duration of the control units (14, 15, 16) of the supply drums (7, 8, 9) in response to the measurement of weft thread delivery made during the weaving process; and means for selectively adjusting the control time and duration time of at least one auxiliary jet (33) in response to the measurement of weft thread delivery made during the weaving process.

14. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, said adjustable control comprising the combination of:

means for measuring weft thread delivery during the weaving process, said measuring means disposed along the loom width;

means for controlling the control time of the master jets (10, 11 and 12) in response to the measurement of weft thread delivery made during the weaving process;

means for controlling the control time of the control units (14, 15, 16) of the supply drums (7, 8, 9) in response to the measurement of weft thread delivery made during the weaving process; and means for controlling the control time of at least one auxiliary jet (33) in response to the measurement of weft thread delivery made during the weaving process.

15. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, said adjustable control comprising the combination of:

means for measuring weft thread delivery during the weaving process, said measuring means disposed along the loom width;

means for controlling the duration time of the master jets (10, 11 and 12) in response to the measurement of weft thread delivery made during the weaving process;

means for controlling the duration of the control units (14, 15, 16) of the supply drums (7, 8, 9) in response to the measurement of weft thread delivery made during the weaving process; and means for controlling the duration time of at least one auxiliary jet (33) in response to the measurement of weft thread delivery made during the weaving process.

16. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, said adjustable control comprising the combination of:

means for measuring weft thread delivery during the weaving process, said measuring means comprising means for sensing weft stop motion;

means for selectively adjusting the control time and the duration time of the master jets (10, 11 and 12) according to the measurement of weft thread delivery made during the weaving process;

means for selectively adjusting the control time and the control duration of the control units (14, 15, 16) of the supply drums (7, 8, 9) according to the measurement of weft thread delivery made during the weaving process; and means for selectively adjusting the control time and duration time of at least one auxiliary jet (33) according to the measurement of weft thread delivery made during the weaving process.

17. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate drums (7, 8 and 9) with control units (14, 15 and 16) and in which auxiliary jets (33), which also operate with an adjustable operating pressure, are controlled according to a specific timing sequence, said adjustable control comprising the combination of:

means for measuring weft thread delivery during the weaving process, said measuring means comprising means for sensing weft stop motion;

means for controlling the control time of the master jets (10, 11 and 12) according to the measurement of weft thread delivery made during the weaving process;

means for controlling the control time of the control units (14, 15, 16) of the supply drums (7, 8, 9) according to the measurement of weft thread delivery made during the weaving process; and means for controlling the control time of at least one auxiliary jet (33) according to the measurement of weft thread delivery made during the weaving process.

18. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these maters jets (10, 11 and 12) are supplied fom separate supply drums (7, 8 and 9) with control units (14, 15 and 16) and in which auxiliary jets (33), which also operate with an adjustable operating pressure, are controlled according to a specific timing sequence, said adjustable control comprising the combination of:

means for measuring weft thread delivery during the weaving process, said measuring means comprising means for sensing weft stop motion;

means for controlling the duration time of the master jets (10, 11 and 12) according to the measurement of weft thread delivery made during the weaving process;

means for controlling the duration time of the control units (14, 15, 16) of the supply drums (7, 8, 9) according to the measurement of weft thread delivery made during the weaving process; and means for controlling the duration time of at least one auxiliary jet (33) according to the measurement of weft thread delivery made during the weaving process.

19. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjusting operating pressure, are controlled according to a specific timing sequence, said adjustable control comprising the combination of:

means for measuring and generating signals corresponding to weft thread delivery during the weaving process, said measuring means comprising at least one sensor located along the loom width and means for sensing weft stop motion of the loom;

means for selectively adjusting the control time and the duration time of the master jets (10, 11 and 12) according to the measurement of weft thread delivery made during the weaving process;

means for selectively adjusting the control time and the control duration of the control units (14, 15, 16) of the supply drums (7, 8, 9) according to the measurement of weft thread delivery made during the weaving process;

means for selectively adjusting the control time and duration time of at least one auxiliary jet (33) according to the measurement of weft thread delivery made during the weaving process; and a master control unit (17) arranged to receive said signals corresponding to weft thread delivery and to regulate operation of the said means for selectively adjusting the (i) control time and the duration time of the master jets (10, 11 and 12); (ii) the control time and control duration of the control units (14, 15, 16) of the supply drums (7, 8 and 9); and (iii) the control time and duration time of said at least one auxiliary jet (33) in response to said signals.

20. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, said adjustable control comprising the combination of:

means for measuring and generating signals corresponding to weft thread delivery during the weaving process, said measuring means comprising at least one sensor located along the loom width and means for sensing weft stop motion of the loom;

means for adjusting the control time of the master jets (10, 11 and 12) according to the measurement of weft thread delivery made during the weaving process;

means for adjusting the control time of the control units (14, 15, 16) of the supply drums (7, 8, 9) according to the measurement of weft thread delivery made during the weaving process;

means for adjusting the control time of at least one auxiliary jet (33) according to the measurement of weft thread delivery made during the weaving process; and a master control unit (17) arranged to receive said signals corresponding to weft thread delivery and to regulate operation of the said means for adjusting the (i) control time of the master jets (10, 11 and 12); (ii) the control time of the control units (14, 15, 16) of the supply drums (7, 8 and 9); and (iii) the control time of said at least one auxiliary jet (33) in response to said signals.

21. An adjustable control for the weft thread of a weaving loom of the type in which, for each type of weft thread (1, 2 and 3), separate master jets (10, 11 and 12) are supplied with compressed air at an operating pressure suitable for the relevant weft thread, in which these master jets (10, 11 and 12) are supplied from separate supply drums (7, 8 and 9) with control units (14, 15 and 16) and in which auxiliary jets (33), which also operate with an adjustable operating pressure, are controlled according to a specific timing sequence, said adjustable control comprising the combination of:

means for measuring and generating signals corresponding to weft thread delivery during the weaving process, said measuring means comprising at least one sensor located along the loom width and means for sensing weft stop motion of the loom;

means for adjusting the duration time of the master jets (10, 11 and 12) according to the measurement of weft thread delivery made during the weaving process;

means for adjusting the duration time of the control units (14, 15, 16) of the supply drums (7, 8, 9) according to the measurement of weft thread delivery made during the weaving process;

means for adjusting the duration time of at least one auxiliary jet (33) according to the measurement of weft thread delivery made during the weaving process; and a master control unit (17) arranged to receive said signals corresponding to weft thread delivery and to regulate operation of the said means for adjusting the (i) duration time of the master jets (10, 11 and 12); (ii) the control duration of the control units (14, 15, 16) of the supply drums (7, 8 and 9); and (iii) the duration time of said at least one auxiliary jet (33) in response to said signals.

* * * * *